United States Patent [19]

Peltola et al.

[11] Patent Number: 4,931,140

[45] Date of Patent: Jun. 5, 1990

[54] METHOD AND A DEVICE FOR CUTTING A WEB IN A PAPER MACHINE BY MEANS OF A WATER JET

[75] Inventors: Pentti T. Peltola; Jounj R. R. Berggvist, both of Anjala, Finland

[73] Assignee: Oy Tampella AB, Tampere, Finland

[21] Appl. No.: 277,696

[22] Filed: Nov. 30, 1988

[30] Foreign Application Priority Data

Dec. 9, 1987 [FI] Finland ..... 875412

[51] Int. Cl.[5] ..... D21G 9/00

[52] U.S. Cl. ..... 162/193; 162/195; 83/53; 83/177; 83/428

[58] Field of Search ..... 162/193, 194, 195, 255, 162/262, 277, 282, 310; 83/53, 177, 428

[56] References Cited

U.S. PATENT DOCUMENTS

| | | | |
|---|---|---|---|
| 1,459,161 | 6/1923 | Roberts | 162/277 |
| 3,190,628 | 6/1965 | Litzka | 83/177 |
| 3,625,813 | 12/1971 | Eckelman | 162/193 |
| 3,809,606 | 5/1974 | Stansbrey | 162/194 |
| 4,540,469 | 9/1985 | Lundström | 162/277 |
| 4,567,796 | 2/1986 | Kloehn et al. | 83/177 |
| 4,573,382 | 3/1986 | Kloehn et al. | 83/53 |

*Primary Examiner*—W. Gary Jones
*Assistant Examiner*—Christopher Upton
*Attorney, Agent, or Firm*—Ladas & Parry

[57] ABSTRACT

A method and a device for cutting an edge strip in a web by means of a water jet against a felt or wire of a paper machine for the threading of the web, whereby the end of the web is passed through the paper machine by means of the edge strip cut in the web, the edge strip being narrower than the web. In order to prevent the felt or wire from getting wet or being choked, the water jet is displaced back and forth across the direction of travel of the web so that the water jet cuts a gently wavelike edge in the edge strip. Correspondingly, the water used in the cutting and the filling agent or other such waste possibly separated from the web spread over the web over a wider area instead of spreading linearly, whereby the felt or wire will not get wet or choked.

4 Claims, 1 Drawing Sheet

METHOD AND A DEVICE FOR CUTTING A WEB IN A PAPER MACHINE BY MEANS OF A WATER JET

Figure 1:
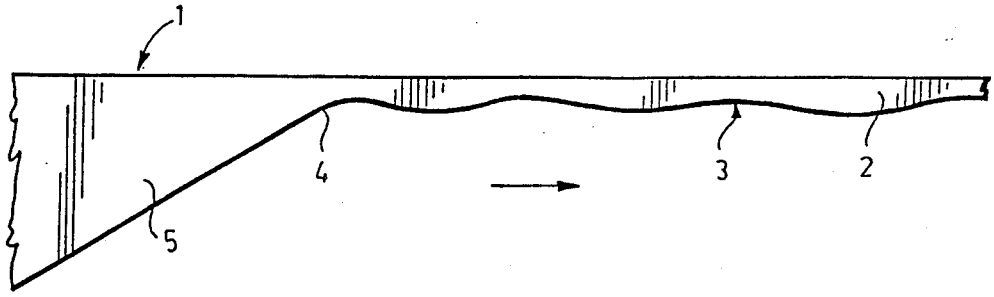

This invention relates to a method of cutting an edge strip in a web by means of a water jet against a felt or wire in a paper machine for threading the web, whereby the end of the web is passed through the paper machine by means of the edge strip cut in the web, the edge strip being narrower than the web. The invention is also concerned with a device for applying the method, the device comprising a nozzle positioned within the area of the felt or the wire for forming a cutting water jet, a body transverse to the direction of travel of the web for supporting the nozzle, and displacing means for positioning the nozzle and, as a consequence, the water jet appropriately in place in the direction of width of the web.

Cutters utilizing water jets are used for cuting the edge of a web in a paper machine and particularly at the beginning of a production process for cutting in the web a narrow edge strip which is then gradually broadened up to the full web width by displacing the water jet across the web. As used in this patent application and claims, the term paper machine refers to a paper or paper board machine or the like machine in which a thin web is produced from a fibre suspension similarly as in paper production. In most cases, such a cutting device is disposed within the former section of the paper machine, either prior to or immediately after the wire suction space. For making the cutting process more efficient, the device is in certain cases placed on a pick up felt, whereby the cutting process itself can be carried out successfully though with disadvantageous side effects.

Since the threading of a web takes quite a lot of time, the cutting jet causes changes in the state of the wire or felt as compared with the rest of it, which in turn results in subsequent disturbances in the process.

With paper kinds containing no filling agent, such as newsprint, a wet web may tend to rejoin after it has been cut. At the terminal end of the press section, where the edge strip is passed on while the part cut off the web is passed into a broke pulper, the broke tends to draw the edge of the paper with it and even cut it off with resultant production disturbances.

With pulp kinds containing a filling agent, the filling agent separated from the web by the nozzle chokes the web at the cutting point, which deteriorates the suction effect of the web. Deterioration in the suction effect causes marking in the web, which possibly results in the formation of unnecessary great amounts of broke.

The object of the present invention is to provide a method by means of which the above problems are avoided and wherein a cutting water jet can be used in the area of a pick up felt or the like felt. A further object of the invention is to provide a device for applying the method. The method according to the invention is characterized in that for preventing the felt or wire from getting wet and from being choked during the cutting of the edge strip, a cutting water jet is moved back and forth across the direction of travel of the web, the edge strip so obtained varying in width.

An essential idea of the invention is that instead of positioning a water jet at a fixed point in the direction of width of the web, the water jet is caused to move back and forth at a suitable rate so that the water jet makes contact with the felt over a wider area in the direction of width thereof. Thereby the water jet does not very often hit one particular point of the felt so that in place of one linear wet area of the water now spreads evenly over a wider area, whereby the felt does not get wet during threading and the filling agent possibly separated from the web does not choke the felt because it correspondingly spreads over a wider area.

The device according to the invention, in turn, is characterized in that it comprises oscillation means for bringing the water jet into a reciprocating movement across the direction of travel of the web during the cutting of the edge strip. An essential feature of the invention is that conventional cutting means utilizing a water jet are provided with means for displacing the nozzle for the water jet in a desired manner so that the cutting water beam moves back and forth in the transverse direction of the web within the area of the web. In this way the water and the possible filling agent entering the felt spread over a wider area in place of a linear area.

Figure 2:
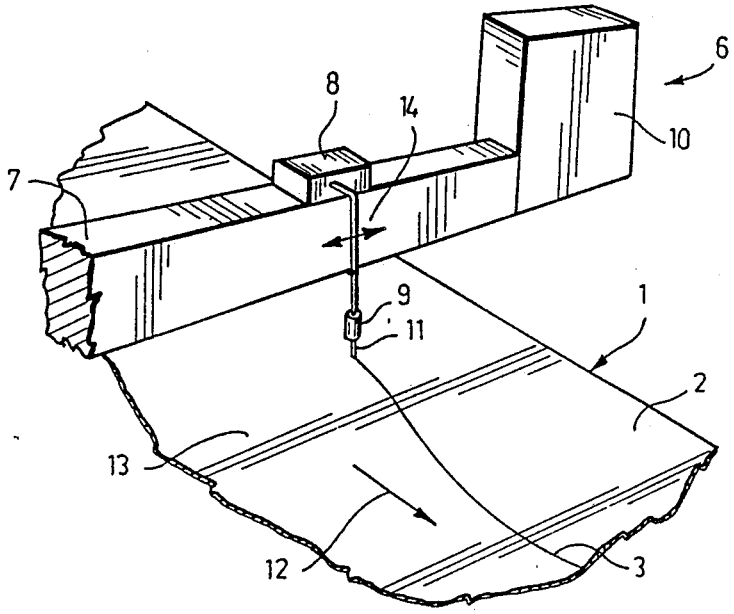

The invention will be described in more detail in the attached drawings, wherein FIG. 1 illustrates schematically the leading end of a web cut by means of the method according to the invention; and FIG. 2 illustrates schematically a device intended for the application of the method according to the invention.

FIG. 1 shows a web which is indicated generally with the reference numeral 1. At the beginning of a production process, i.e., in the so called threading of a web, an edge strip generally 15 to 20 cm in thickness is cut in the edge of the web at the leading end thereof. The edge strip is passed through the machine until the web can be widened to its full width by displacing the cutting water jet across the wire or felt, whereafter normal production can be initiated. In FIG. 1, the edge strip is indicated with the reference numeral 2 and the cut edge of the edge strip by the reference numeral 3. In the method according to the invention, the edge strip is cut by displacing the cutting water jet in the transverse direction of the web within a few centimeters, typically about 3 to 4 cm, so that the edge of the edge strip gets a gently wavelike shape, and the water of the cutting water jet spreads over an area several centimeters in width in the felt under the web. After the edge strip 2 has been passed through the paper machine, the water jet cutter is arranged to be displaced in the transverse direction of the web at a constant rate at a point indicated with the reference numeral 4, so that a wedge-shaped leading end 5 is formed in the web 1.

In a web cut according to the method, the width of the edge strip 2 varies, which is unimportant as such since the edge strip is rejected as broke at the other end of the apparatus. On the other hand, the felt under the web does not get wet and is not choked as the wavelike movement causes the water jet as well as the filling material possibly separated from the web to spread over an area several centimeters in width instead of spreading linearly, on account of which the runnability of the machine des not suffer. Similarly, when the web 2 does not contain any filling agent, it remains relatively dry during the cutting, wherefore it does not tend to rejoin.

FIG. 2 shows schematically a device for applying the method according to the invention. In the device, cutting means 6 comprise a beamlike body 7 positioned in the transverse direction of the paper machine and provided with a nozzle carriage 8 displaceable longitudinally therealong. The nozzle carriage comprises a cutting nozzle 9 reaching close to the surface of the web to be cut. The device further comprises a transport mechanism 10 at the end of the body 7. Such a device is generally known per se and its structure and operation will not be described in more detail herein. Similarly, it is generally known to mount such a device at various places in a paper machine, so the structure of the paper machine or constructions required for such mounting will not be described.

A thin water jet 11 is applied from the cutting nozzle 9 to the web so that it penetrates the web, thus cutting the web 1 moving thereunder into two parts. When the web moves in the direction shown by the arrow 12, a cutting line is formed in the web, which separates on its opposite sides an edge strip 2 and a portion 13 which is directly passed into a broke pulper. In the preferred embodiment of the invention, the reciprocating movement is achieved merely by connecting a driving mechanism 10 to the conventional diagonal cutting means for displacing the nozzle carriage 8 back and forth under the control of a microprocessor or the like. Thereby it is possible to use e.g. an existing process control computer only by providing it with a new control program. When the nozzle carriage 8 is caused to move back and forth by means of the driving mechanism 10 in a suitably oscillating manner shown by the arrow 14, the water jet emerging from the nozzle 9 correspondingly moves back and forth in the transverse direction of the web 1. As a result, a gently wavelike cutting line is obtained, and, correspondingly, an edge 3 of the edge strip 2 gets a gently wavelike shape. The wavelike shape of the edge strip does not in any way affect adversely the threading of the strip but the threading takes place exactly similarly as previously with an edge strip cut straight. If the rate of the driving mechanism 10 is not adjusted separately but the mechanism is arranged to displace the nozzle carriage 8 at a constant rate over a predetermined distance or for a predetermined period of time in one direction and correspondingly backwards, the edge of the edge strip 2 will be gently triangular in shape.

The cutting process, i.e., the movement of the water jet 11, can also be controlled either by using mechanical devices such as crank means, eccentric means, pump screw mechanism or the like or an electrical or electronic control of the driving mechanism 10 for obtaining a reciprocating movement. Instead of moving the nozzle carriage, it is as well possible to displace the nozzle 9 across the direction of travel of the web, whereby the nozzle preferably swings back and forth on its tube or holder connecting it to the nozzle carriage under the control of a mechanical, electrical or any other suitable mechanism and a control arrangement. Also, the method can be realized by means of a device in which not only the nozzle carriage 8 or the nozzle 9 but also the beamlike body 7 is brought into a reciprocating movement by means of a mechanical, hydraulic, pneumatic or electrical machinery. Such a device is also easy to realize and only has to be switched on and off during operation. The operation can be arranged to take place as a continuous process, whereby the oscillation according to the method takes place during a predetermined period of time and or over a predetermined feeding distance of the paper machine, whereafter the cutting means automatically starts to broaden the web by diagonal cutting. In the same way the oscillation can be switched on manually and the diagonal cutting can be started manually at a suitable stage without automation.

We claim:

1. A method of cutting, by means of a water jet, an edge strip in a web passing over a felt or wire in a paper machine for the threading of the web, whereby the end of the web is passed through the paper machine by means of the edge strip cut in the web, the edge strip being narrower than the web, said method comprising moving a cutting water jet back and forth across the direction of travel of the web for preventing the felt or wire from getting excessively wet and from being choked during the cutting of the edge strip, the edge strip so obtained varying in width.

2. A method according to claim 1, wherein the water jet is moved back and forth substantially slowly as compared with the rate of travel of the web.

3. A method according to claim 2, wherein the water jet is moved back and forth in an oscillating manner, whereby the cut edge in the edge strip is gently wavelike in shape.

4. A method according to claim 1 wherein, subsequent to the formation of a predetermined length of said edge strip, said water jet is moved at a substantially constant rate in a direction inwardly of the width of the web to cause a linear increase in the width of the advancing edge strip.

* * * * *